US011703253B2

(12) United States Patent
Heo et al.

(10) Patent No.: US 11,703,253 B2
(45) Date of Patent: Jul. 18, 2023

(54) WATER HEATING APPARATUS AND METHOD FOR CONTROLLING THE APPARATUS

(71) Applicant: Kyungdong Navien Co., LTD, Gyeonggi-do (KR)

(72) Inventors: Chang Heoi Heo, Seoul (KR); Yong Min Song, Seoul (KR); Nam Soo Do, Seoul (KR)

(73) Assignee: KYUNGDONG NAVIEN CO., LTD

( * ) Notice: Subject to any disclaimer, the term of this patent is extended or adjusted under 35 U.S.C. 154(b) by 206 days.

(21) Appl. No.: 17/130,763

(22) Filed: Dec. 22, 2020

(65) Prior Publication Data

US 2021/0190377 A1 Jun. 24, 2021

(30) Foreign Application Priority Data

Dec. 24, 2019 (KR) ..... 10-2019-0174300

(51) Int. Cl.
*F24H 9/20* (2022.01)
*F24H 1/12* (2022.01)
(Continued)

(52) U.S. Cl.
CPC ..... *F24H 9/2007* (2013.01); *F24H 1/12* (2013.01); *F24D 3/02* (2013.01); *F24D 19/1066* (2013.01);
(Continued)

(58) Field of Classification Search
CPC .. F24D 3/02; F24D 19/1066; F24D 2220/044; F24H 1/12; F24H 1/124;
(Continued)

(56) References Cited

U.S. PATENT DOCUMENTS 7,597,066 B2 * 10/2009 Shimada ..... F23N 1/082 122/406.1
2009/0223465 A1 * 9/2009 Yamaoka ..... F24H 1/186 122/14.3
2016/0187028 A1 * 6/2016 Shimada ..... F24D 19/1051 122/14.3

FOREIGN PATENT DOCUMENTS

CN 110542215 A * 12/2019
JP 2011-099602 A 5/2011
(Continued)

OTHER PUBLICATIONS

KR 101810769 B1 Translation (Year: 2018).*
CN 110542215 A Translation (Year: 2019).*

*Primary Examiner* — Steven B McAllister
*Assistant Examiner* — Benjamin W Johnson
(74) *Attorney, Agent, or Firm* — McDonald Hopkins LLC

(57) ABSTRACT

A water heating apparatus includes a sensor to detect an inflow water amount flowing into the water heating apparatus, and a controller to determine connection or disconnection between the water heating apparatus and a water storage tank, based on the inflow water amount flowing into the water heating apparatus for a preset time duration. Thus, the water heating apparatus determines whether or not the water storage tank is connected thereto based on the amount of inflow water introduced into the water heating apparatus. Then, the water heating apparatus determines the operation mode of the water heating apparatus based on the determination result. Thus, even when the user incorrectly sets the operation mode of the water heating apparatus, the water heating apparatus may actively and correctly operate.

16 Claims, 4 Drawing Sheets

(51) Int. Cl.
*F24D 3/02* (2006.01)
*F24D 19/10* (2006.01)
*F24H 1/46* (2022.01)

(52) U.S. Cl.
CPC ..... *F24D 2220/044* (2013.01); *F24H 1/124* (2013.01); *F24H 1/125* (2013.01); *F24H 1/46* (2013.01); *F24H 9/2035* (2013.01)

(58) Field of Classification Search
CPC ..... F24H 1/125; F24H 1/46; F24H 9/2007; F24H 9/2035
USPC ..... 122/14.3
See application file for complete search history.

(56) References Cited

FOREIGN PATENT DOCUMENTS

| | | | | |
|---|---|---|---|---|
| KR | 101810769 | B1 | * | 1/2018 |
| KR | 10-2018-0091378 | A | | 8/2018 |

* cited by examiner

WATER HEATING APPARATUS AND METHOD FOR CONTROLLING THE APPARATUS

CROSS-REFERENCE TO RELATED APPLICATION

This application claims the benefit of priority to Korean Patent Application No. 10-2019-0174300, filed in the Korean Intellectual Property Office on Dec. 24, 2019, the entire contents of which are incorporated herein by reference.

TECHNICAL FIELD

The present disclosure relates to a water heating apparatus and a method for controlling the apparatus.

BACKGROUND

In general, a water heating apparatus is a heating apparatus for supplying hot water. A mode for supplying hot water may include an instantaneous mode and a storage mode. In the instantaneous mode, when direct water flows, instantaneous heating of the water is performed using an instantaneous heat exchanger and the heated water is supplied to the apparatus. The instantaneous mode is preferable when hot water is needed instantaneously. In the instantaneous mode, change in an inflow water amount flowing into the water heating apparatus is large. In the storage mode, while storing direct water in a water storage tank (hot water tank), the water storage tank is heated to a constant temperature and thus hot water is supplied to the apparatus. The storage mode is preferable when a relatively large amount of hot water is required. Because the inflow water amount is determined according to a lift of a pump, the inflow water amount is almost constant.

Further, when setting the water heating apparatus, a user must set the instantaneous mode or the storage mode based on connection or disconnection between the water heating apparatus and the water storage tank. When the connection or disconnection between the water heating apparatus and the water storage tank is not considered and thus an operation mode of the apparatus is incorrectly set, the water heating apparatus malfunctions, thus causing inconvenience to the user.

SUMMARY

The present disclosure has been made to solve the above-mentioned problems occurring in the prior art while advantages achieved by the prior art are maintained intact.

An aspect of the present disclosure provides a water heating apparatus and a method for controlling the apparatus in which connection or disconnection between the water storage tank and the water heating apparatus based on a user's usage pattern is determined and then an operation mode of the water heating apparatus is determined based on the determination result.

The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a water heating apparatus includes a sensor to detect an inflow water amount flowing into the water heating apparatus, and a controller to determine connection or disconnection between the water heating apparatus and a water storage tank, based on the inflow water amount flowing into the water heating apparatus for a preset time duration.

The controller may detect the inflow water amount per unit time, obtain inflow water amounts detected per the unit time for a predefined time, and calculate an average inflow water amount based on the inflow water amounts acquired for the predefined time.

The controller may calculate the average inflow water amount each time the predefined time has elapsed for the preset time duration and thus calculate a N-th average inflow water amount corresponding to a N-th period of the preset time duration, and calculate N-th maximum inflow water and minimum inflow water amounts when the preset time duration has elapsed, based on a (N−2)-th average inflow water amount, a (N−1)-th minimum inflow water amount, and a (N−1)-th maximum inflow water amount.

The controller may determine that the water heating apparatus and the water storage tank are not connected to each other when a difference between the N-th maximum inflow water amount and the N-th minimum inflow water amount exceeds a first reference value.

The controller may determine that the water heating apparatus and the water storage tank are not connected to each other when the N-th minimum inflow water amount is N/10 ($0<N<4$) of the N-th maximum inflow water amount.

The controller may determine an operation mode of the water heating apparatus as an instantaneous mode when it is determined that the water heating apparatus and the water storage tank are not connected to each other.

The controller may calculate a maximum inflow water amount and a minimum inflow water amount per the preset time duration, and to determine a difference between the maximum inflow water amount and the minimum inflow water amount.

The controller may confirm that the water heating apparatus and the water storage tank are connected to each other when the difference between the maximum inflow water amount and the minimum inflow water amount is smaller than a second reference value smaller than the first reference value, and determine a confirmation count of the connection.

The controller may confirm that the water heating apparatus and the water storage tank are connected to each other when the minimum inflow water amount is N/10 ($7\leq N<10$) of the maximum inflow water amount, and determine a confirmation count of the connection.

The controller may determine the operation mode of the water heating apparatus as a storage mode when it is determined that the determined confirmation count is greater than or equal to a reference count.

According to an aspect of the present disclosure, a method for controlling a water heating apparatus includes detecting an inflow water amount flowing into the water heating apparatus, and determining connection or disconnection between the water heating apparatus and a water storage tank, based on the inflow water amount flowing into the water heating apparatus for a preset time duration.

The method may further include, after the detecting of the inflow water amount flowing into the water heating apparatus, obtaining inflow water amounts detected per the unit time for a predefined time, and calculating an average inflow water amount based on the inflow water amounts acquired for the predefined time.

The method may further include, after the calculating of the average inflow water amount, calculating the average inflow water amount each time the predefined time has elapsed for the preset time duration and thus calculating a N-th average inflow water amount corresponding to a N-th period of the preset time duration, and calculating N-th maximum inflow water and minimum inflow water amounts when the preset time duration has elapsed, based on a (N−2)-th average inflow water amount, a (N−1)-th minimum inflow water amount, and a (N−1)-th maximum inflow water amount.

The determining of connection or disconnection between the water heating apparatus and the water storage tank may include determining that the water heating apparatus and the water storage tank are not connected to each other when a difference between the N-th maximum inflow water amount and the N-th minimum inflow water amount exceeds a first reference value.

The determining of connection or disconnection between the water heating apparatus and the water storage tank may include determining that the water heating apparatus and the water storage tank are not connected to each other when the N-th minimum inflow water amount is N/10 ($0<N<4$) of the N-th maximum inflow water amount.

The method may further include determining an operation mode of the water heating apparatus as an instantaneous mode when it is determined that the water heating apparatus and the water storage tank are not connected to each other.

The method may further include calculating a maximum inflow water amount and a minimum inflow water amount per the preset time duration, and determining a difference between the maximum inflow water amount and the minimum inflow water amount.

The determining of connection or disconnection between the water heating apparatus and the water storage tank may include confirming that the water heating apparatus and the water storage tank are connected to each other when the difference between the maximum inflow water amount and the minimum inflow water amount is smaller than a second reference value smaller than the first reference value, and determining a confirmation count of the connection.

The determining of connection or disconnection between the water heating apparatus and the water storage tank may include confirming that the water heating apparatus and the water storage tank are connected to each other when the minimum inflow water amount is N/10 ($7\leq N<10$) of the maximum inflow water amount, and determining a confirmation count of the connection.

The method may further include determining the operation mode of the water heating apparatus as a storage mode when it is determined that the determined confirmation count is greater than or equal to a reference count.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
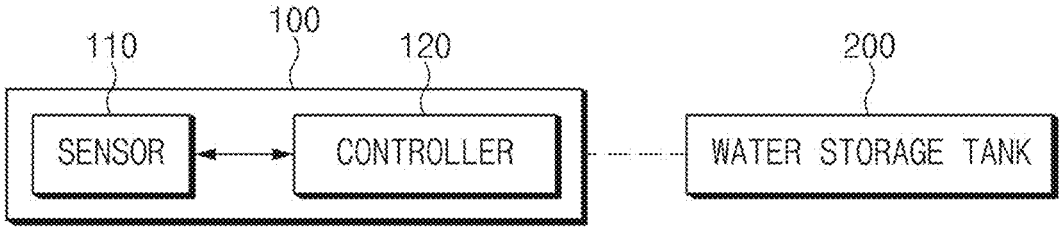
FIG. 1 is a diagram showing a configuration of a water heating apparatus according to an embodiment of the present disclosure.

Hereinafter, some embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of the related known configuration or function will be omitted when it is determined that it interferes with the understanding of the embodiment of the present disclosure.

In describing the components of the embodiment according to the present disclosure, terms such as first, second, A, B, (a), (b), and the like may be used. These terms are merely intended to distinguish the components from other components, and the terms do not limit the nature, order or sequence of the components. Unless otherwise defined, all terms including technical and scientific terms used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

FIG. 1 is a diagram showing a configuration of a water heating apparatus according to an embodiment of the present disclosure.

As shown in FIG. 1, a water heating apparatus 100 may include a sensor 110 and a controller 120.

The sensor 110 may detect ab amount of inflow water flowing into the water heating apparatus. To this end, the sensor 110 may be implemented as a flow sensor. The sensor 110 may detect the amount of inflow water per unit time. According to an embodiment, the sensor 110 may detect the amount of inflow water every second.

The controller 120 may be implemented using various processing units such as a microprocessor having a built-in semiconductor chip capable of performing operation or execution of various instructions. The controller 120 may control operations of the water heating apparatus according to an embodiment of the present disclosure. Specifically, the controller 120 may determine connection or disconnection between the water heating apparatus and the water storage tank 200 based on the amount of inflow water introduced thereto for a preset time duration. In addition, the controller 120 may be configured to guide the determination result about whether the water heating apparatus and the water storage tank 200 are connected to each other.

More specifically, the controller 120 may control the sensor 110 to detect the amount of inflow water flowing into the water heating apparatus per unit time. When the amount of inflow water detected per unit time is acquired for a predefined time, the controller may calculate an average inflow water amount based on the inflow water amounts acquired for the predefined time. The calculation of the average inflow water amount will be explained in more detail with reference to FIG. 2.

Figure 2:
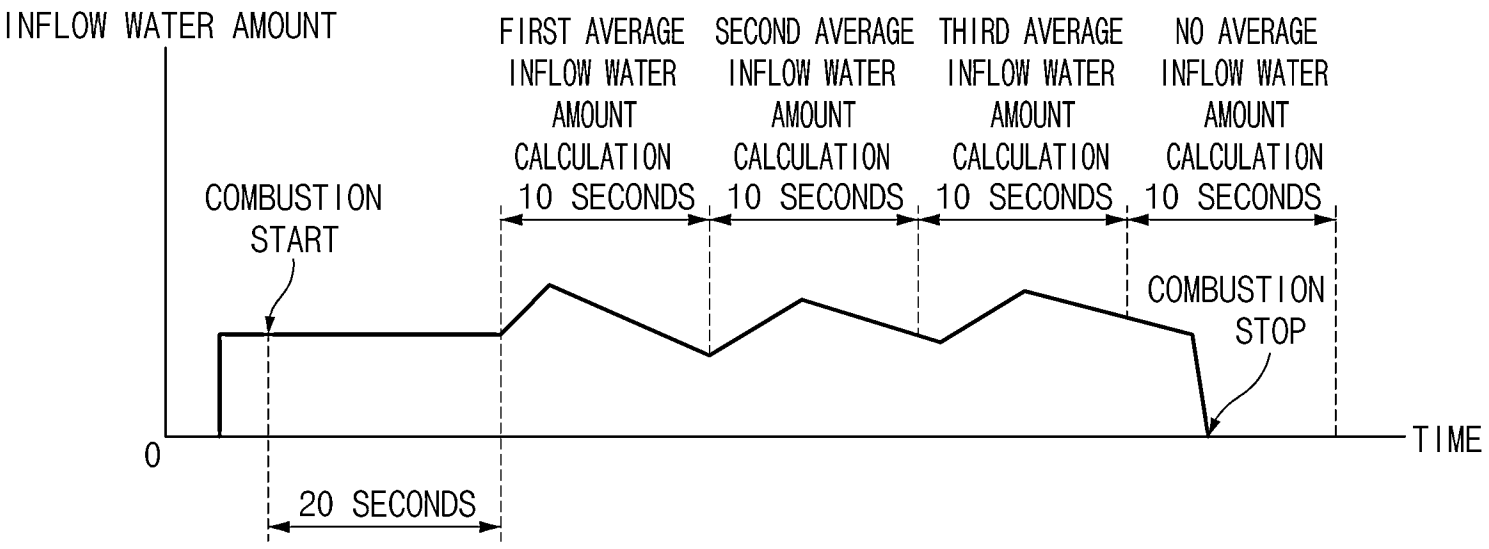
FIG. 2 is a graph showing an amount of inflow water detected by a water heating apparatus according to an embodiment of the present disclosure.

FIG. 2 is a graph showing the amount of inflow water detected by the water heating apparatus according to an embodiment of the present disclosure.

As shown in FIG. 2, the controller 120 may acquire the inflow water amount detected per unit time for 10 seconds after a certain period of time, e.g. 20 seconds has elapsed since combustion starts. The controller 120 may calculate the average inflow water amount based on the inflow water amounts acquired for 10 seconds. In other words, the controller 120 may calculate a first average inflow water amount based on the inflow water amounts acquired for first 10 seconds after a certain period of time has elapsed since the start of combustion. In addition, the controller 120 may then calculate an average inflow water amount every time the predefined time elapses. Therefore, the controller 120 may calculate a second average inflow water amount based on the inflow water amounts detected per unit time for a period of 11 seconds to 20 seconds and may calculate a third average inflow water amount based on inflow water amounts detected per unit time for a period of 21 seconds to 30 seconds. According to an embodiment of the present disclosure, when it is determined that the combustion is stopped, the controller 120 may be configured not to calculate the average inflow water amount for a period including the combustion stop time.

In addition, the controller 120 may calculate an average inflow water amount each time a predefined time elapses for a preset time duration, and, after the preset time duration has elapsed, may calculate a minimum inflow water amount and a maximum inflow water amount based on the average inflow water amounts calculated each time the predefined time elapses. The minimum inflow water amount and the maximum inflow water amount will be described in more detail with reference to FIG. 3.

Figure 3:
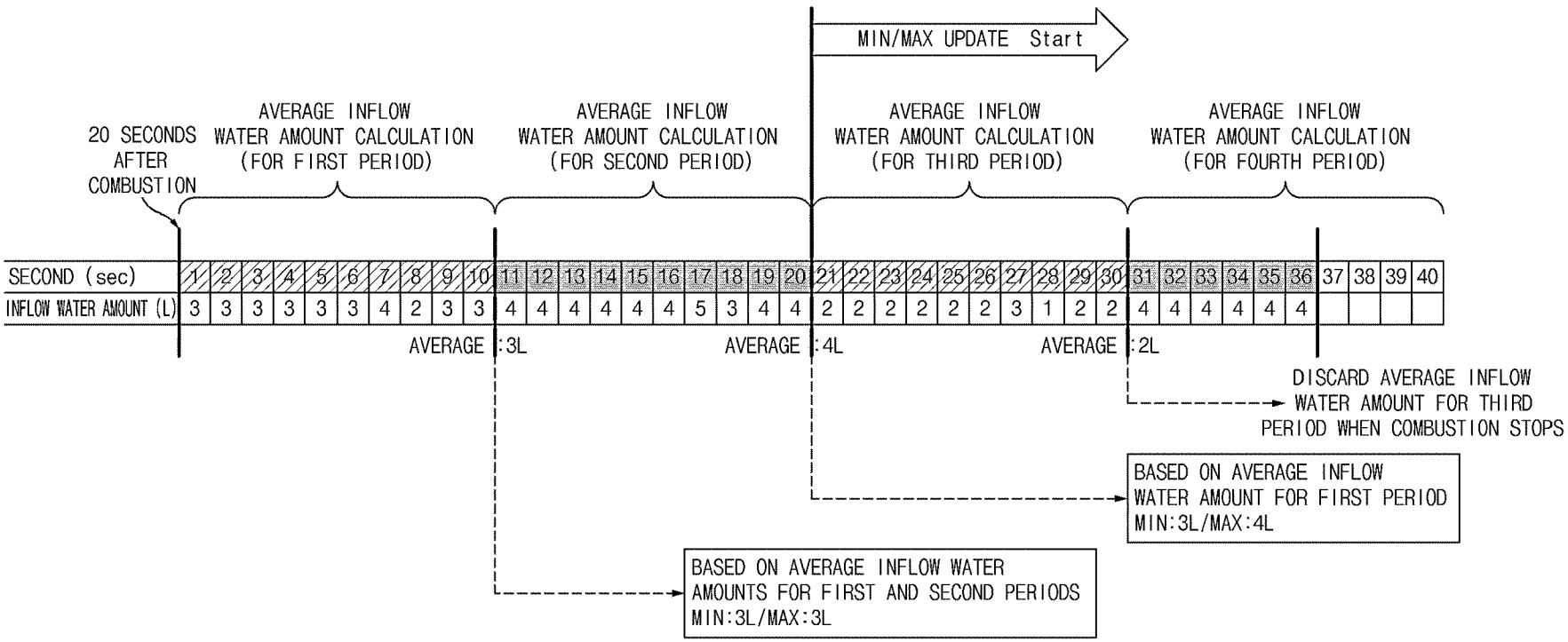
FIG. 3 is a diagram schematically showing setting of a minimum inflow water amount and a maximum inflow water amount based on calculated average inflow water amounts according to an embodiment of the present disclosure.

FIG. 3 is a diagram schematically showing setting of the minimum inflow water amount and the maximum inflow water amount based on calculated average inflow water amounts according to an embodiment of the present disclosure.

As shown in FIG. 3, when a certain period of time, e.g., seconds has elapsed since the start of combustion, the controller 120 may acquire the inflow water amounts detected per 1 second of the unit time for 10 seconds. According to an embodiment, the controller 120 may calculate the first average inflow water amount as 3 L based on the inflow water amounts acquired for a period from 1 second to 10 seconds (first period). When the second average inflow water amount is calculated as 4 L based on the inflow water amounts acquired for a period from 11 seconds to 20 seconds (second period). Then, the controller 120 may determine that at least two average inflow water amounts are calculated.

When the controller 120 determines that the at least two average inflow water amounts are calculated, the controller 120 may calculate a N-th minimum inflow water amount and a N-th maximum inflow water amount as a minimum value and a maximum value among a (N−2)-th average inflow water amount, a (N−1)-th minimum inflow water amount, and a (N−1)-th maximum inflow water amount. Reference is made to Table 1 for a more detailed description thereof. Table 1 shows an average inflow water amount, a minimum inflow water amount and a maximum inflow water amount calculated for each period.

TABLE 1

| | First period | Second period | Third period | Fourth period | Fifth period | . . . |
|---|---|---|---|---|---|---|
| Average inflow water amount | 3 liters | 4 liters | 2 liters | 3 liters | 3 liters | . . . |
| Minimum inflow water amount | — | — | 3 liters | 3 liters | 2 liters | . . . |
| Maximum inflow water amount | — | — | 3 liters | 4 liters | 4 liters | . . . |

According to an embodiment, the controller 120 may calculate a third minimum inflow water amount and a third maximum inflow water amount based on a first average inflow water amount, a second minimum inflow water amount, and a second maximum inflow water amount. Referring to Table 1, because the first average inflow water amount is 3 liters, and a second minimum inflow water amount and a second maximum inflow water amount are not calculated, the controller 120 may calculate the first average inflow water amount 3 liters as the third minimum inflow water amount and the third maximum inflow water amount.

According to an embodiment, the controller 120 may calculate a fourth minimum inflow water amount and a fourth maximum inflow water amount based on the second average inflow water amount, the third minimum inflow water amount and the third maximum inflow water amount. Referring to Table 1, because the second average inflow water amount is 4 liters, and each of the third minimum inflow water amount and the third maximum inflow water amount is 3 liters, the controller 120 may calculate the minimum value thereof, that is, 3 liters, as the fourth minimum inflow water amount, and the maximum value thereof, that is, 4 liters as the fourth maximum inflow water amount.

According to another embodiment, the controller 120 may calculate a fifth minimum inflow water amount and a fifth maximum inflow water amount based on the third average inflow water amount, the fourth minimum inflow water amount, and the fourth maximum inflow water amount. Referring to Table 1, because the third average inflow water amount is 2 liters, the fourth minimum inflow water amount is 3 liters, and the fourth maximum inflow water amount is 4 liters, the controller 120 may calculate the third average inflow water amount 2 liters as the minimum value thereof as the fifth minimum inflow water amount, and may calculate the fourth maximum inflow water amount 4 liters as the maximum value thereof as the fifth maximum inflow water amount.

In this manner, the controller 120 may calculate the average inflow water amount every time the predefined time elapses for a preset time duration, for example, 24 hours, and may calculate the minimum inflow water amount and maximum inflow water amount when the preset time duration e.g. 24 hours has elapsed.

Further, when a difference between the maximum inflow water amount and the minimum inflow water amount when the preset time duration, for example, 24 hours has elapsed exceeds a first reference value, the controller 120 may determine that the water heating apparatus and the water storage tank are not connected to each other. According to an embodiment, when the minimum inflow water amount at the time when the preset time duration has elapsed is N/10 (0<N<4) of the maximum inflow water amount at the time when the preset time duration has elapsed, the controller 120 may determine that the difference between the maximum inflow water amount and the minimum inflow water amount exceeds the first reference value and thus may determine that the water heating apparatus and the water storage tank are not connected to each other. When the controller 120 determines that the water heating apparatus and the water storage tank are not connected to each other, the controller 120 may notify that the water heating apparatus and the water storage tank are not connected to each other, and may determine an operation mode of the water heating apparatus as an instantaneous mode. In this connection, the instantaneous mode may mean a mode in which when direct water flows, the water instantaneously heated using an instantaneous heat exchanger, and then the heated water is supplied.

When the controller 120 determines that the difference between the maximum inflow water amount and the minimum inflow water amount when the preset time duration has elapsed does not exceed the first reference value, or that the minimum inflow water amount at the time when the preset time duration has elapsed is not N/10 (0<N<4) of the maximum inflow water amount at the time when the preset time duration has elapsed, the controller 120 is not able to determine a connection state between the water heating apparatus and the water storage tank. Accordingly, the controller 120 does not determine the operation mode of the water heating apparatus as the instantaneous mode. Therefore, the controller 120 may determine the operation mode of the water heating apparatus in a manner as shown in Table 2.

TABLE 2

| Timing | Inflow water amount comparison | Connection or disconnection between water storage tank and apparatus | Operation mode |
|---|---|---|---|
| When 24 hours has lapsed | Minimum inflow water amount being N/10 (0 < N < 4) of maximum inflow water amount | Disconnection | Instantaneous mode |

Further, the controller 120 may calculate the maximum inflow water amount and the minimum inflow water amount each time the preset time duration elapses, and may determine a difference between the maximum inflow water amount and the minimum inflow water amount calculated each time the preset time duration elapses. In addition, the controller 120 may determine connection or disconnection between the water heating apparatus and the water storage tank based on the difference between the maximum inflow water amount and the minimum inflow water amount. In addition, the controller 120 may determine the operation mode of the water heating apparatus as the storage mode when it is determined that a count of confirmations of the connection between the water heating apparatus and the water storage tank is greater than or equal to a reference count.

According to an embodiment, the controller 120 may calculate the maximum inflow water amount and the minimum inflow water amount each time the preset time duration elapses, for example, 24 hours elapses. When a difference between the maximum inflow water amount and the minimum inflow water amount as calculated is smaller than a second reference value which is smaller than the first reference value, the controller 120 may determine that the water heating apparatus and the water storage tank are connected to each other. According to an embodiment, the controller 120 may calculate the maximum inflow water amount and the minimum inflow water amount each time the preset time duration elapses. When the minimum inflow water amount is N/10 (7≤N<10) of the maximum inflow water amount, the controller may determine that the difference between the maximum inflow water amount and the minimum inflow water amount is smaller than the second reference value which is smaller than the first reference value. Thus, the controller 120 may determine that the water heating apparatus and the water storage tank are connected to each other.

Further, the controller 120 may calculate the maximum inflow water amount and the minimum inflow water amount per preset time duration. When a count of confirmations that the water heating apparatus and the water storage tank are connected to each other is equal to or above a reference count (e.g., 3), the controller 120 may determine the operation mode of the water heating apparatus as the storage mode. In this connection, the storage mode may mean a mode in which while storing direct water in a water storage tank (hot water tank), the water storage tank is heated to a constant temperature and thus hot water is supplied to the apparatus.

That is, the controller 120 may determine the connection or disconnection between the water heating apparatus and the water storage tank, based on the maximum inflow water amount and the minimum inflow water amount calculated for each preset time duration. When it is determined that a count of confirmations that the water heating apparatus and the water storage tank are connected to each other is smaller than the reference count, the controller 120 may not determine the operation mode of the water heating apparatus as the storage mode. However, when it is determined that a count of confirmations that the water heating apparatus and the water storage tank are connected to each other is greater than or equal to the reference count, the controller 120 may determine the operation mode of the water heating apparatus as the storage mode. Therefore, the controller 120 may determine the operation mode of the water heating apparatus in a manner as shown in Table 3.

TABLE 3

| Timing | Inflow water amount comparison | Connection or disconnection between water storage tank and apparatus | Operation mode |
|---|---|---|---|
| When 24 hours elapses | Minimum inflow water amount being N/10 (7 ≤ N < 10) of maximum inflow water amount | Connected (confirmation count = 1) | Not determined |
| When 48 hours elapses | Minimum inflow water amount being N/10 (7 ≤ N < 10) of maximum inflow water amount | Connected (confirmation count = 2) | Not determined |
| When 72 hours elapses | Minimum inflow water amount being N/10 (7 ≤ N < 10) of maximum inflow water amount | Connected (confirmation count = 3) | Determined as storage mode |

In accordance with one embodiment of the present disclosure, the controller 120 may determine the operation mode of the water heating apparatus as the storage mode. Thus, the water heating apparatus may operate in the storage mode. However, when a problem in the supply of hot water continues to occur even after operating in the storage mode, the controller 120 may determine that a temperature setting of an automatic temperature control device (aquastat) connected to the water storage tank is set to be high, or that a contact point of the automatic temperature control device is in a faulty state, and may notify this situation.

Figure 4:
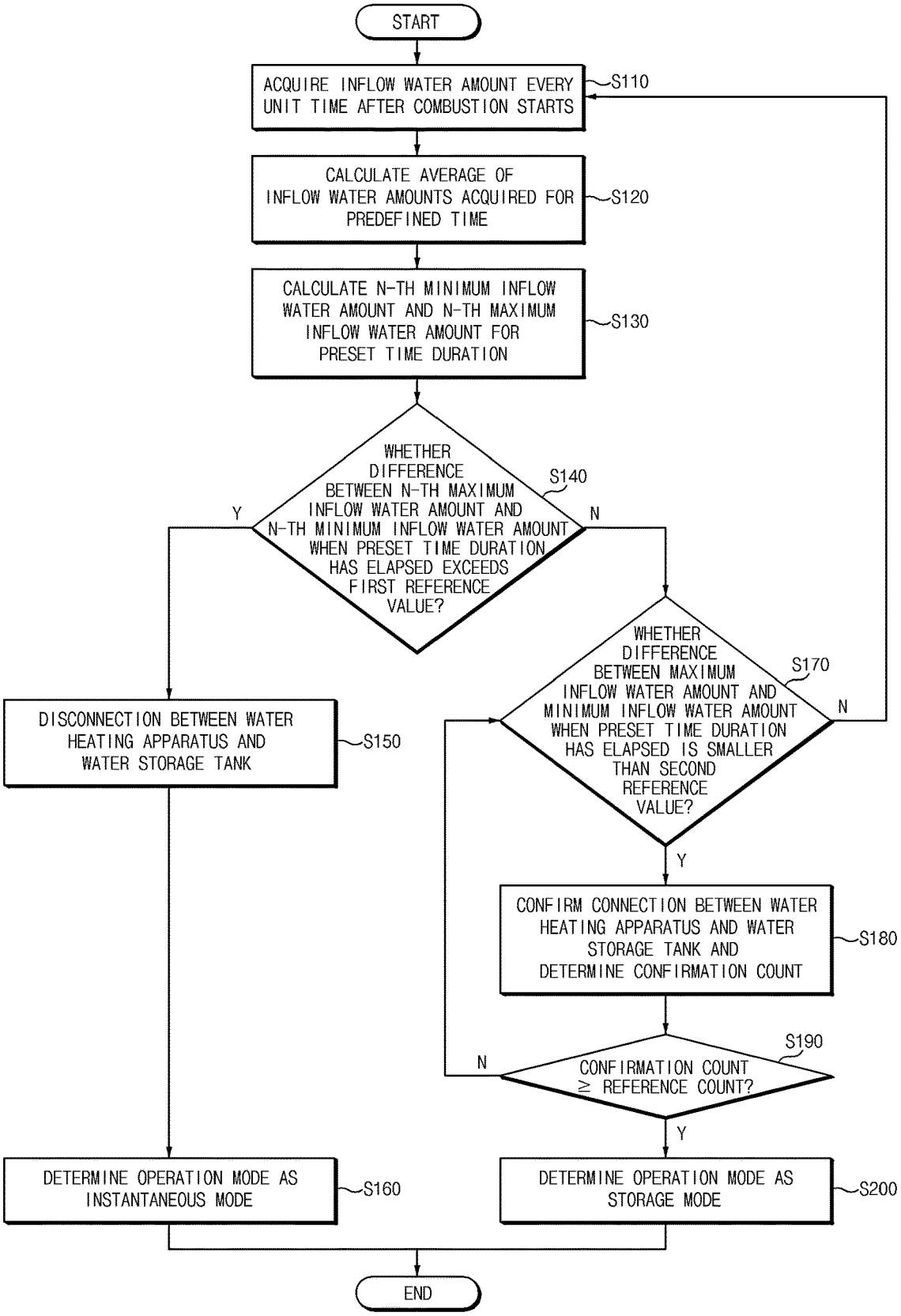
FIG. 4 is a diagram showing a control method of a water heating apparatus according to an embodiment of the present disclosure.

FIG. 4 is a view showing a water heating method according to an embodiment of the present disclosure.

As shown in FIG. 4, the controller 120 may acquire the amount of inflow water detected by the sensor 110 every unit time after combustion starts (S110). In S110, the controller 120 may acquire the amount of inflow water detected every second.

The controller 120 calculates the average of the amounts of inflow water acquired for a predefined time (S120). In S120, the controller 120 may calculate the average of the amounts of inflow water obtained for 10 seconds.

The controller 120 calculates the N-th minimum inflow water amount and the N-th maximum inflow water amount for the preset time duration (S130). In S130, the controller 120 may calculate the N-th minimum inflow water amount and the N-th maximum inflow water amount based on the average inflow water amounts calculated each time the predefined time elapses for the preset time duration. According to an embodiment, when the controller 120 determines that at least two average inflow water amounts are calculated in S130, the controller 120 may calculate the N-th minimum inflow water amount and the N-th maximum inflow water amount respectively as the minimum and maximum values among the (N−2)-th average inflow water amount, the (N−1)-th minimum inflow water amount, and the (N−1)-th maximum inflow water amount. For a more detailed description thereof, refer to Table 1 above.

The controller 120 compares the N-th minimum inflow water amount and the N-th maximum inflow water amount for the preset time duration with each other, and determines whether the difference between the N-th maximum inflow water amount and the N-th minimum inflow water amount when the preset time duration has elapsed exceeds the first reference value (S140). When, in S140, the minimum inflow water amount at the time when the preset time duration has elapsed is N/10 ($0<N<4$) of the maximum inflow water amount at the time when the preset time duration has elapsed, the controller 120 may determine that the difference between the maximum inflow water amount and the minimum inflow water amount exceeds the first reference value. When, in S140, the difference between the maximum inflow water amount and the minimum inflow water amount when the preset time duration, for, example, 24 hours has elapsed exceeds the first reference value (Y), the controller 120 determines that the water heating apparatus and the water storage tank are not connected to each other (S150). In addition, when the controller 120 determines that the water heating apparatus and the water storage tank are not connected to each other, the controller 120 may determine the operation mode of the water heating apparatus as the instantaneous mode (S160). In this connection, the instantaneous mode may mean a mode in which when direct water flows, the water instantaneously heated using an instantaneous heat exchanger, and then the heated water is supplied.

When in S140, the controller 120 determines that the difference between the N-th maximum inflow water amount and the N-th minimum inflow water amount when the preset time duration has elapsed does not exceed the first reference value (N), the controller 120 calculates the maximum inflow water amount and the minimum inflow water amount each time the preset time duration elapses. The controller 120 determines whether the difference between the maximum inflow water amount and the minimum inflow water amount when the preset time duration has elapsed is smaller than the second reference value smaller than the first reference value (S170). When, in S170, the minimum inflow water amount when the preset time duration has elapsed is N/10 ($7\leq N<10$) of the maximum inflow water amount when the preset time duration has elapsed, the controller 120 may determine that the difference between the maximum inflow water amount and the minimum inflow water amount is smaller than the second reference value.

When, in S170, the controller 120 determines that a state in which the difference between the maximum inflow water amount and the minimum inflow water amount when the preset time duration, for example, 72 hours has elapsed is smaller than the second reference value continuously lasts and has a predefined count (Y), the controller 120 confirms that the water heating apparatus and the water storage tank are connected to each other, and determines the confirmation count (S180). In addition, the controller 120 determines whether a count of the confirmations of the connection between the water heating apparatus and the water storage tank is greater than or equal to the reference count (S190). According to an embodiment, in S190, the reference count may be 3 and may not be limited thereto. When, in S190, the controller 120 determines that the count of the confirmations of the connection between the water heating apparatus and the water storage tank is equal to or greater than the reference count, the controller 120 determines the operation mode of the water heating apparatus as the storage mode (S200). In S200, the storage mode refers to a mode in which while storing direct water in the water storage tank (hot water tank), the water storage tank is heated to a constant temperature and thus hot water is supplied to the apparatus. To the contrary, when in S190, the controller 120 determines that the count of the confirmations of the connection between the water heating apparatus and the water storage tank smaller than the reference count, the controller performs S110.

The water heating apparatus and method according to an embodiment of the present disclosure determines whether or not the water storage tank is connected thereto based on the amount of inflow water introduced into the water heating apparatus. Then, the water heating apparatus and method determines the operation mode of the water heating apparatus based on the determination result. Thus, even when the user incorrectly sets the operation mode of the water heating apparatus, the water heating apparatus may actively and correctly operate.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A water heating apparatus comprising:

a sensor configured to detect an inflow water amount flowing into the water heating apparatus; and a controller configured to determine connection or disconnection between the water heating apparatus and a water storage tank, based on the inflow water amount flowing into the water heating apparatus for a preset time duration, wherein the controller is configured to:

detect the inflow water amount per unit time;

obtain inflow water amounts detected per the unit time for a predefined time; and calculate an average inflow water a mount based on the inflow water amounts acquired for the predefined time;

calculate the average inflow water amount each time the predefined time has elapsed for the preset time duration and thus calculate a N-th average inflow water amount corresponding to a N-th period of the preset time duration; and calculate N-th maximum inflow water and minimum inflow water a mounts when the preset time duration has elapsed, based on a (N−2)-th average inflow water a mount, a (N−1)-th minimum inflow water amount, and a (N−1)-th maximum inflow water amount.

2. The apparatus of claim 1, wherein the controller is configured to determine that the water heating apparatus and the water storage tank are not connected to each other when a difference between the N-th maximum inflow water amount and the N-th minimum inflow water amount exceeds a first reference value.

3. The apparatus of claim 2, wherein the controller is configured to determine that the water heating apparatus and the water storage tank are not connected to each other when the N-th minimum inflow water amount is N/10 ($0<N<4$) of the N-th maximum inflow water amount.

4. The apparatus of claim 3, wherein the controller is configured to determine an operation mode of the water heating apparatus as an instantaneous mode when it is determined that the water heating apparatus and the water storage tank are not connected to each other.

5. The apparatus of claim 2, wherein the controller is configured to calculate a maximum inflow water amount and a minimum inflow water amount per the preset time duration, and to determine a difference between the maximum inflow water amount and the minimum inflow water amount.

6. The apparatus of claim 5, wherein the controller is configured to:

confirm that the water heating apparatus and the water storage tank are connected to each other when the difference between the maximum inflow water amount and the minimum inflow water amount is smaller than a second reference value smaller than the first reference value; and determine a confirmation count of the connection.

7. The apparatus of claim 6, wherein the controller is configured to confirm that the water heating apparatus and the water storage tank are connected to each other when the minimum inflow water amount is N/10 ($7\leq N<10$) of the maximum inflow water amount; and to determine a confirmation count of the connection.

8. The apparatus of claim 7, wherein the controller is configured to determine an operation mode of the water heating apparatus as a storage mode when it is determined that the determined confirmation count is greater than or equal to a reference count.

9. A method for controlling a water heating apparatus, the method comprising:

detecting an inflow water amount flowing into the water heating apparatus; and determining connection or disconnection between the water heating apparatus and a water storage tank, based on the inflow water a mount flowing into the water heating apparatus for a preset time duration, wherein the method further comprises:

after the detecting of the inflow water a mount flowing into the water heating apparatus, obtaining inflow water a mounts detected per unit time for a predefined time;

calculating an average inflow water amount based on the inflow water amounts acquired for the predefined time;

after the calculating of the average inflow water amount, calculating the average inflow water amount each time the predefined time has elapsed for the preset time duration and thus calculating a N-th average inflow water amount corresponding to a N-th period of the preset time duration; and calculating N-th maximum inflow water and minimum inflow water amounts when the preset time duration has elapsed, based on a (N−2)-th average inflow water amount, a (N−1)-th minimum inflow water amount, and a (N−1)-th maximum inflow water amount.

10. The method of claim 9, wherein the determining of connection or disconnection between the water heating apparatus and the water storage tank includes determining that the water heating apparatus and the water storage tank are not connected to each other when a difference between the N-th maximum inflow water amount and the N-th minimum inflow water amount exceeds a first reference value.

11. The method of claim 10, wherein the determining of connection or disconnection between the water heating apparatus and the water storage tank includes determining that the water heating apparatus and the water storage tank are not connected to each other when the N-th minimum inflow water amount is N/10 ($0<N<4$) of the N-th maximum inflow water amount.

12. The method of claim 11, wherein the method further comprises determining an operation mode of the water heating apparatus as an instantaneous mode when it is determined that the water heating apparatus and the water storage tank are not connected to each other.

13. The method of claim 10, wherein the method further comprises:

calculating a maximum inflow water amount and a minimum inflow water amount per the preset time duration; and determining a difference between the maximum inflow water amount and the minimum inflow water amount.

14. The method of claim 13, wherein the determining of connection or disconnection between the water heating apparatus and the water storage tank includes:

confirming that the water heating apparatus and the water storage tank are connected to each other when the difference between the maximum inflow water amount and the minimum inflow water amount is smaller than a second reference value smaller than the first reference value; and determining a confirmation count of the connection.

15. The method of claim 14, wherein the determining of connection or disconnection between the water heating apparatus and the water storage tank includes:

confirming that the water heating apparatus and the water storage tank are connected to each other when the minimum inflow water amount is N/10 ($7 \leq N < 10$) of the maximum inflow water amount; and determining a confirmation count of the connection.

16. The method of claim 15, wherein the method further comprises determining an operation mode of the water heating apparatus as a storage mode when it is determined that the determined confirmation count is greater than or equal to a reference count.

* * * * *